United States Patent [19]

Van Coney

[11] Patent Number: 4,842,165

[45] Date of Patent: Jun. 27, 1989

[54] RESILIENT SQUEEZE BOTTLE PACKAGE FOR DISPENSING VISCOUS PRODUCTS WITHOUT BELCHING

[75] Inventor: Robert H. Van Coney, Cincinnati, Ohio

[73] Assignee: The Procter & Gamble Company, Cincinnati, Ohio

[21] Appl. No.: 90,862

[22] Filed: Aug. 28, 1987

[51] Int. Cl.[4] ..... B65D 35/28

[52] U.S. Cl. ..... 222/95; 222/105; 222/183; 222/207; 222/212; 222/386.5; 222/490; 222/571

[58] Field of Search ..... 222/94, 95, 105, 107, 222/183, 209, 212, 213, 490, 491, 494–497, 386.5, 571, 207

[56] References Cited

U.S. PATENT DOCUMENTS

| | | | |
|---|---|---|---|
| 1,122,868 | 12/1914 | Davis | 222/490 |
| 1,206,661 | 11/1916 | Booth | 222/490 |
| 1,242,654 | 10/1917 | Chapman | 222/490 |
| 1,491,860 | 4/1924 | Holden | 222/104 |
| 1,631,931 | 6/1927 | Geake | 272/104 |
| 1,859,397 | 5/1932 | Johnson et al. | 222/490 |
| 1,989,145 | 1/1935 | Newby | 222/490 X |
| 2,557,120 | 6/1951 | Knoblock | 222/95 X |
| 2,608,320 | 8/1952 | Harrison, Jr. | 222/95 |
| 2,743,038 | 4/1956 | Ferries | 222/95 |
| 2,759,636 | 8/1956 | Albert et al. | 222/103 |
| 2,777,612 | 1/1957 | Bensen | 222/209 |
| 2,804,995 | 9/1957 | Fee | 222/183 |
| 2,944,705 | 7/1960 | Strumor | 222/94 |
| 3,055,553 | 9/1962 | Mapes et al. | 222/95 |
| 3,067,787 | 12/1962 | Salk | 222/490 X |
| 3,081,066 | 3/1963 | Land | 222/212 |
| 3,223,289 | 12/1965 | Bouet | 222/209 |
| 3,258,175 | 6/1966 | Taylor | 222/490 X |
| 3,262,605 | 7/1966 | Madden et al. | 222/103 |
| 3,275,193 | 9/1966 | Barr | 222/95 |
| 3,295,725 | 1/1967 | Brandt | 222/107 |
| 3,306,500 | 2/1967 | Williams | 222/209 |
| 3,332,579 | 7/1967 | Peters | 222/96 |
| 3,339,803 | 9/1967 | Wayne et al. | 222/95 |
| 3,360,169 | 12/1967 | Susuki et al. | 222/494 X |
| 3,381,857 | 5/1968 | Francis | 222/100 |
| 3,592,360 | 7/1971 | Aleck | 222/95 |
| 3,592,365 | 7/1971 | Schwartzman | 222/209 |
| 3,669,323 | 6/1972 | Harker et al. | 222/490 |
| 3,674,183 | 7/1972 | Venable et al. | 222/212 |
| 3,675,822 | 7/1972 | Casali et al. | 222/103 |
| 3,731,844 | 5/1973 | Baker | 222/83 |
| 3,767,078 | 10/1973 | Gortz et al. | 222/95 X |
| 3,833,154 | 9/1974 | Markowitz | 222/212 |
| 3,837,533 | 9/1974 | Splan | 222/94 |
| 3,908,863 | 9/1975 | White | 222/103 |

(List continued on next page.)

FOREIGN PATENT DOCUMENTS

| | | | |
|---|---|---|---|
| 1017080 | 10/1957 | Fed. Rep. of Germany | 222/490 |
| 2364168 | 4/1978 | France | 222/495 |

*Primary Examiner*—Kevin P. Shaver

*Attorney, Agent, or Firm*—E. Kelly Linman; John V. Gorman; Richard C. Witte

[57] ABSTRACT

A resilient squeeze bottle dispensing package capable of dispensing viscous products without excessive air entrainment and belching on successive dispensing cycles. In a preferred embodiment, the viscous product is preferably suspended inside a resilient squeeze bottle in a thin flexible bag. The flexible bag is secured about its perimeter to the interior of the squeeze bottle at its top and approximately at its midpoint to facilitate both complete emptying of product and desirable suckback characteristics when the opposed squeezing forces ae removed from the resilient outer wall of the bottle. A suckback valve is located between the dispensing orifice in the shroud of the package and the flexible bag to limit the amount of air which can enter the package through the dispensing orifice at the conclusion of each dispensing cycle and to prevent slumping of viscous product remaining in the shroud into the bottom of the flexible bag between dispensing cycles. An air check valve is preferably provided in the bottom of the resilient squeeze bottle to facilitate a pressure buildup within the bottle when opposed squeezing forces are applied thereto.

25 Claims, 5 Drawing Sheets

U.S. PATENT DOCUMENTS

| | | | |
|---|---|---|---|
| 3,915,342 | 10/1975 | Van Bussel | 222/103 |
| 3,931,834 | 1/1976 | Caillet | 222/386.5 X |
| 3,936,334 | 2/1976 | Kushida et al. | 222/95 X |
| 3,938,706 | 2/1976 | Cohen | 222/95 X |
| 3,995,772 | 12/1976 | Liautaud | 222/83.5 |
| 4,020,978 | 5/1977 | Szczepanski | 222/209 |
| 4,027,784 | 6/1977 | Mattson | 222/102 |
| 4,089,437 | 5/1978 | Chutter et al. | 222/94 |
| 4,098,434 | 7/1978 | Uhlig | 222/94 |
| 4,133,457 | 1/1979 | Klassen | 222/212 |
| 4,154,366 | 5/1979 | Acres | 222/95 |
| 4,295,582 | 10/1981 | Acres | 222/213 |
| 4,457,453 | 7/1984 | Stevens et al. | 222/213 X |
| 4,469,250 | 9/1984 | Eyezich | 222/95 X |
| 4,513,891 | 4/1985 | Hain et al. | 222/213 |
| 4,562,942 | 1/1986 | Diamond | 222/386.5 |
| 4,657,151 | 4/1987 | Cabernoch | 222/107 X |
| 4,671,428 | 6/1987 | Spatz | 222/105 |
| 4,728,006 | 3/1988 | Drobish et al. | 222/213 X |
| 4,760,937 | 8/1988 | Evezich | 222/95 |

RESILIENT SQUEEZE BOTTLE PACKAGE FOR DISPENSING VISCOUS PRODUCTS WITHOUT BELCHING

TECHNICAL FIELD

The present invention has relation to a resilient squeeze bottle dispensing package which is suitable for dispensing viscous products such as toothpaste.

The present invention has further relation to such a dispensing package which is easy to use, which is able to dispense the desired amount of toothpaste on a toothbrush, which reduces the accumulation of product around the dispensing orifice and which regains its original shape after each use.

The present invention has further relation to such a package which substantially prevents belching due to air entrainment on successive dispensing cycles.

The present invention has further relation to such a package which is capable of upright storage and which exhibits a relatively small footprint, thereby minimizing the amount of counter space required.

Finally, the present invention has relation to such a package which is economical to manufacture.

BACKGROUND OF THE INVENTION

Viscous materials, such as toothpaste, are commonly packaged in collapsible tubes which offer the advantages of low cost and ease of use. However, consumer satisfaction with tubes has been limited by their messiness and their poor appearance during storage and use. In addition, they can be inconvenient to store because they occupy a large area when laid flat.

More recently, mechanical pumps have been introduced with some success because they overcome the negative of poor appearance during use and provide ease of storage. However, their acceptance has been somewhat limited by poor economy and the difficulties they present in dispensing product.

Conventional squeeze bottles have not been a practical alternative because viscous products, such as toothpaste, will not readily flow or drain to the dispensing orifice. In addition, the dispensing operation becomes increasingly difficult as more and more of the package contents are dispensed. This is due to the fact that more and more air is drawn into the package as the contents are dispensed.

Some liquid dentifrice formulations which will flow and which can be dispensed from a squeeze bottle without extreme difficulty have been introduced in conventional squeeze bottle packages. However, for the most part, these products have not been as well received by consumers as the more conventional viscous paste formulations which are not easily dispensed from a conventional squeeze bottle.

OBJECTS OF THE INVENTION

A primary object of the present invention is to provide a resilient squeeze bottle package which can easily and reliably dispense viscous products such as toothpaste.

Another object of the present invention is to provide such a resilient squeeze bottle package which preserves the advantages of collapsible tubes and pumps, while avoiding the major negatives associated with each of these prior art package forms.

It is still another object of the present invention to provide a resilient squeeze bottle package exhibiting the following attributes:

1. Ease of use—easy to hold and physically manipulate the package to dispense product;
2. Control of dispensing—able to dispense the desired amount of viscous product on an object such as a toothbrush;
3. Less mess—reduce the accumulation of product around the dispensing orifice;
4. Neater package appearance throughout use—the package is resilient and regains its original shape after each use;
5. Economy—less costly than the majority of prior art pump dispensers; and
6. Convenient storage—the package stands upright and has a relatively small footprint.

SUMMARY OF THE INVENTION

A package in accordance with the present invention contains a viscous product, such as toothpaste, in a thin flexible bag which is suspended inside a resilient squeeze bottle. The bag is secured about its periphery to the interior of the squeeze bottle at its top and approximately at its midpoint to facilitate both complete emptying of product from the bag as well as desirable suckback characteristics when the squeezing force is removed from the bottle. A suckback valve is located between the dispensing orifice and the bag to limit the amount of air which can enter through the dispensing orifice at the conclusion of each dispensing cycle. An air check valve is preferably provided in the resilient squeeze bottle to facilitate a pressure build-up between the flexible bag and the interior of the bottle when external squeezing forces are applied to the bottle.

When the bottle is squeezed, the air check valve closes. Air pressure builds inside the bottle and exerts pressure on the flexible bag and its contents, causing the suckback valve to open and viscous product in the bag to pass through the suckback valve and be dispensed through the dispensing orifice. When the squeezing force on the bottle is released, the resilient outer side walls of the squeeze bottle spring back toward their undeformed position, carrying the flexible bag secured thereto at its midpoint along with them. This action sharply cuts off the flow of viscous product from the dispensing orifice and causes air to enter the dispensing orifice. It also causes the suckback valve to close, thereby limiting the amount of air allowed to enter the package through the dispensing orifice. In addition, air is drawn through the air check valve which is preferably located in the bottom of the outer container, into the space between the bag and the interior of the squeeze bottle. This collapses the bottom portion of the bag by an amount substantially corresponding to the volume of viscous product dispensed. Limiting the amount of air drawn into the dispensing orifice with the suckback valve permits subsequent dispensing of product, without belching or spurting due to entrained air, on the first squeeze of the bottle.

BRIEF DESCRIPTION OF THE DRAWINGS

While the specification concludes with claims particularly pointing out and distinctly claiming the present invention, it is believed the present invention will be better understood from the following description in which:

DESCRIPTION OF THE PACKAGE

Figure 1:
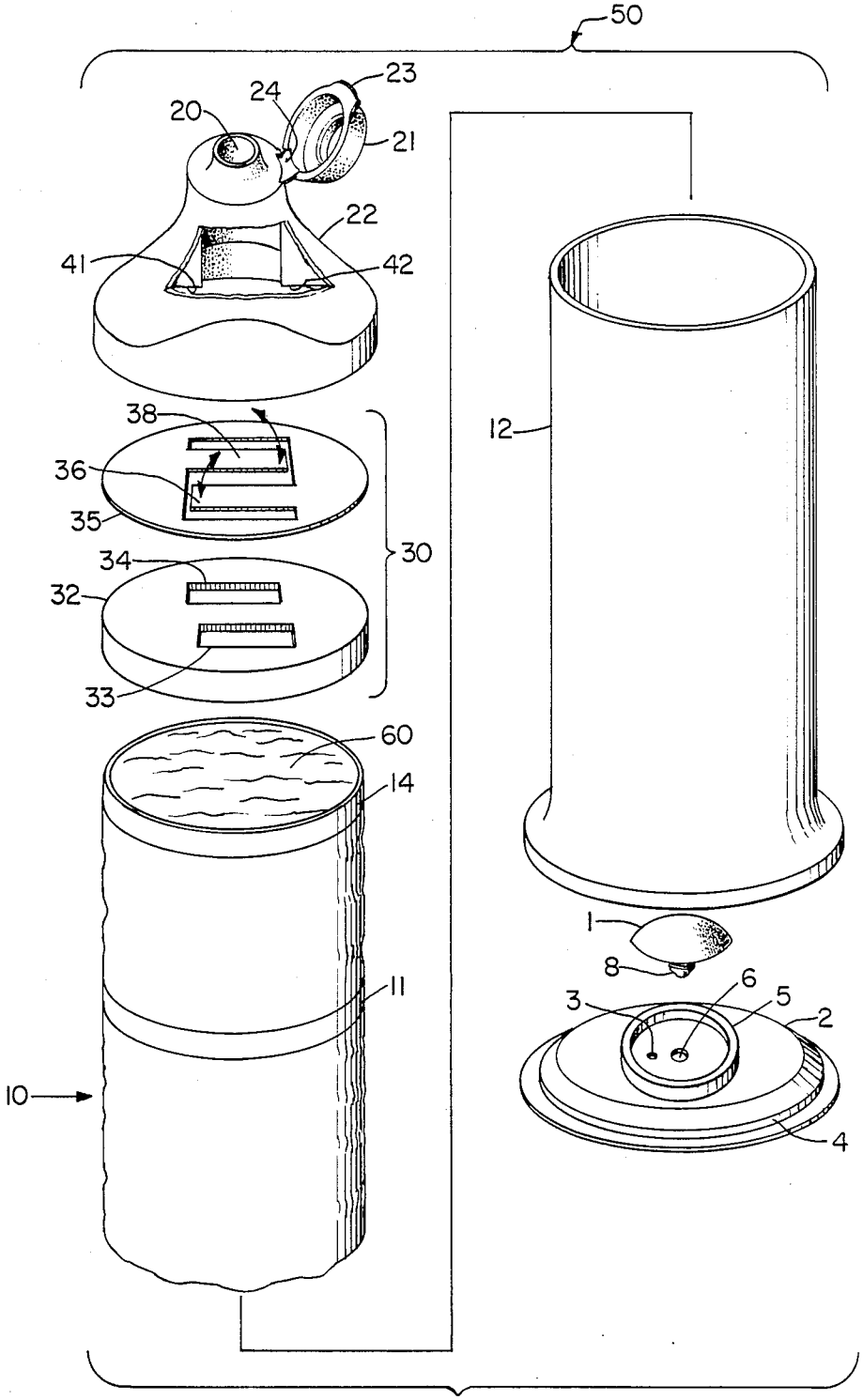
FIG. 1 is a simplified exploded view of a preferred resilient squeeze bottle dispensing package of the present invention.
Figure 2:
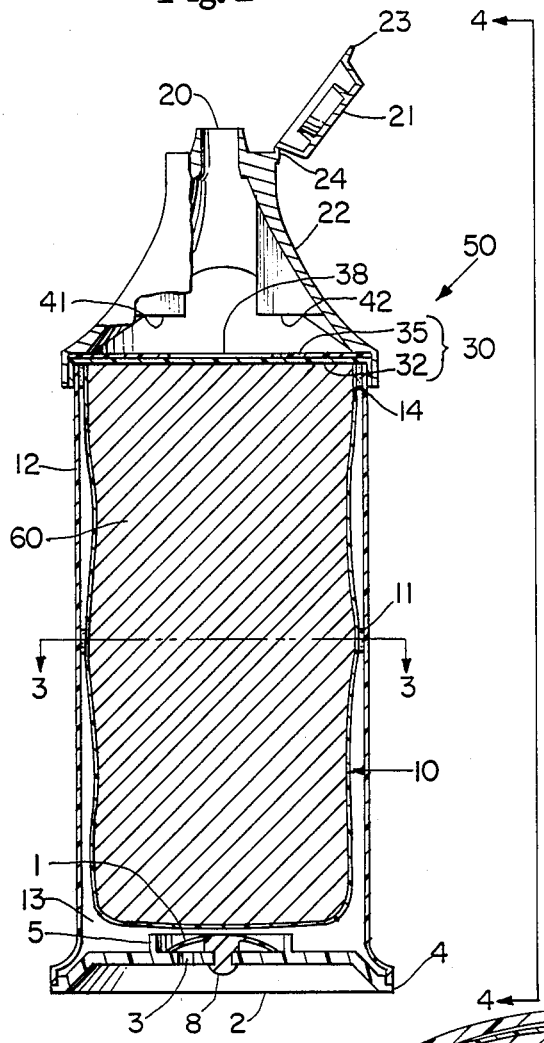
FIG. 2 is a simplified partial cross-sectional view of the dispenser of FIG. 1 shown in an assembled condition.

FIG. 1 is a simplified exploded view of a preferred resilient squeeze bottle dispensing package 50 of the present invention. The basic elements comprising the package 50 illustrated in their assembled condition in the cross-section of FIGS. 2–8 are:

1. Resilient outer wall 12;
2. Base 2 to which the lowermost end of resilient outer wall 12 is sealingly secured;
3. Full length flexible inner bag 10 containing viscous product 60 secured about its periphery to resilient outer wall 12 at its top edge 14 and at a point 11 approximately intermediate the two ends of the resilient outer wall;
4. Suckback valve 30 comprising an orifice plate 32 containing orifices 33 and 34 and a flex plate 35 containing resilient flaps 36 and 38 which, in their closed position, block orifices 33 and 34, respectively;
5. Means, such as air check valve 1, to regulate the flow of air to and from the space 13 existing below the flexible bag 10 and the interior of the package 50;
6. Shroud 22, containing a viscous product dispensing orifice 20; and
7. Closure member 21 hingedly secured to shroud 22.

The Resilient Outer Wall of the Package

Figure 3:
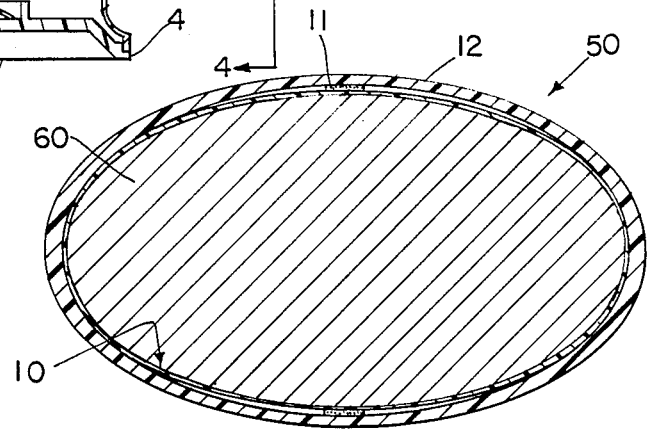
FIG. 3 is a simplified cross-sectional view of the dispenser of FIGS. 1 and 2 taken at a point corresponding to section line 3—3 of FIG. 2.

The resilient outer wall 12 of package 50 may have any cross-section that accommodates the hand of the user. It has been found that an oval cross-section, as generally shown in FIG. 3, having a minor axis of about 3–4 centimeters and a major axis of about 5–6 centimeters is particularly well suited for both children and adults to use. The force required to deflect the resilient outer wall 12 depends upon several factors including: flexural modulus of the materials comprising the outer wall; the wall thickness; the cross-section geometry of the wall; the stiffness of the flexible bag 10; the viscosity of the product 60 contained in the flexible bag 10; the size of the orifices 33 and 34 in orifice plate 32; the stiffness of resilient flaps 36 and 38 in flex plate 35; and the size of the dispensing orifice 20 in shroud 22. The resilient outer wall 12 is preferably made from a resilient plastic, e.g., low density polyethylene, and may be formed by any of several common methods of plastic molding. For example, it may be blow molded, injection molded or extruded. In a particularly preferred embodiment it is comprised of a material capable of being heat sealed to the various other components of the package.

The Base

The base 2 is preferably sealingly secured to the lowermost end of the resilient outer wall 12 by any of several means well known in the art, e.g., adhesive, heat sealing, mechanical interlocking or the like. The lowermost portion of the base 2 preferably comprises a pedestal which provides a flat surface for standing the package 50 erect in a medicine chest or on a countertop. In the illustrated embodiment, the base 2 includes a recessed groove 4 having an exterior dimension substantially coinciding with the interior dimension of the lowermost end of resilient outer wall 12 to permit easy joinder of the base to the lowermost end of the outer wall. Located near the center of the base 2 is a vent hole 3 for admitting air into the package after a dispening cycle has been completed. Immediately adjacent vent hole 3 is a second hole 6 into which the base 8 of a resilient check valve 1 is inserted to secure the check valve in position on the base of the container. A raised ring 5 slightly larger in diameter and taller in height than the uppermost portion of check valve 1 is preferably molded about apertures 3 and 6 to prevent the lowermost surface of the flexible bag 10 from interfering with the operation of the check valve 1 during dispensing, particularly while the bag is full or nearly full.

The Flexible Inner Bag

The flexible inner bag 10 containing the viscous product 60 to be dispensed can be formed by rolling a sheet of flat flexible stock over on itself and forming a lap seal along its length. The outside cross-sectional dimensions of the fully expanded bag are preferably substantially equal to the inside cross-sectional dimensions of the undeformed resilient outer wall 12 of the package. The lower end of the flexible bag 10 is preferably sealed with a gusset so that the width of the seal is no greater than the internal cross-section of the resilient outer wall 12 of the package when the outer wall is in its undeformed condition.

Alternatively, if increased drop strength is desired in the package, the flat stock can be folded upon itself to form the bottom of the flexible bag 10 and a pair of substantially parallel side seals can be made. The flexible bag 10 thus formed exhibits an integral bottom and a pair of face-to-face side seals.

The full length flexible bag 10 shown in Drawing FIGS. 1–8 is preferably placed inside the resilient outer wall 12 of the package and secured at its top edge 14 to the uppermost end of the resilient outer sidewall 12. In addition the flexible bag 10 is secured to the interior of the resilient outer wall 12 approximately at its midpoint 11. The top seal is continuous about the periphery of the bag to prevent loss of viscous product, while the midpoint seal can be continuous or discontinuous, i.e., no leakage will occur from the bag at this point even if the bag is not joined to outer wall 12 about its entire periphery. Midpoint securement of the flexible bag 10 to the resilient outer wall 12 not only insures substantially complete emptying of the viscous product 60 from the package, but in addition, aids the suckback action at the conclusion of each dispensing cycle. This in turn provides sharp cut-off of viscous product at the dispensing orifice 20 as well as a drawing back of air into the dispensing orifice of the package at the end of each dispensing cycle, i.e., the resilience of the outer wall 12 is effectively imparted to the flexible bag 10 due to the area of securement 11 at the approximate midpoint of the bag. Accordingly, the package attempts to create a void corresponding to the dispensed product within the flexible bag 10 almost instantaneously upon removal of the opposing squeezing forces "F" shown in FIG. 4.

Figure 9:
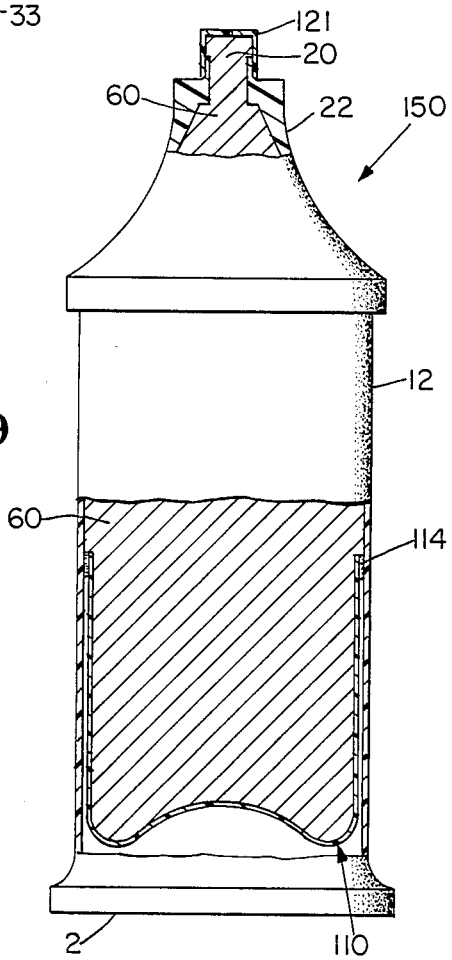
FIG. 9 is a partial cross-sectional view of an alternate resilient squeeze bottle dispensing package of the present invention, said package employing a flexible bag approximately half the length of the bag used in the package embodiment shown in FIGS. 1–8, said bag being sealingly secured about its periphery at its top to the interior of the resilient outer wall of the package at the approximate midpoint of the outer wall.

In still another resilient squeeze bottle package embodiment 150 of the present invention illustrated in the partial cross-sectional view of FIG. 9, the flexible bag 110 can be approximately half the overall length of resilient outer wall 12, and its top 114 sealingly secured to the interior of the outer wall at the approximate midpoint of the outer wall. This seal must be continuous to prevent leakage of product at the point of joinder between the top 114 of the bag 110 and the outer wall 12. While the half bag package embodiment 150 shown in FIG. 9 will dispense viscous product 60 in substantially the same manner as the full length bag package embodiment 50 shown in FIGS. 1–8, the full length bag embodiments are generally preferred when handling viscous products requiring barrier protection during storage. Use of the half bag embodiment in such situations would require imparting barrier properties to both the bag and the product contacting surfaces of resilient outer wall 12.

Filling of the full length flexible bag 10 of package embodiment 50 or the half length bag 110 and the upper portion of the resilient outer side wall 12 of package embodiment 150 with viscous product 60 can be performed after the bag has been secured to the innermost surface of the resilient outer wall 12 and before the addition of suckback valve 30 and shroud 22 to the package. The base 2, including the air check valve 1, is preferably sealingly secured to the lowermost end of the resilient outer wall 12 before filling to permit standing the open topped outer wall and the flexible bag sealingly secured thereto erect during the filling and final assembly operations.

The material for the flexible bag 10 preferably exhibits a low flexural modulus so that the bag can be readily flexed as viscous product 60 is dispensed. This minimizes any contribution to the force required to squeeze the package and dispense product. In addition, because the bag is preferably sealed to itself as well as to the resilient outer wall 12 at its top and midpoint, the bag material is preferably readily heat sealable for ease of assembly.

For products that require a barrier to prevent losses from the product, e.g., flavor or perfume or other active ingredients, the barrier may be incorporated as a layer in the flexible bag 10. Because the bag material may need to possess several different characteristics, the use of a multi-layered laminate film may be particularly suitable. One particularly preferred laminate structure for a multi-layered flexible bag material which has been found satisfactory for housing dentifrice paste comprises the following layers, listed in the order of outer surface to inner surface:

1. Polyethylene layer—0.0010 inches;
2. Metalized aluminum coating—thickness incapable of measurement by conventional means;
3. Polyethylene terephthalate—0.0005 inches; and
4. Polyethylene—0.0010 inches.

The particular material selected for flexible bag 10 will, of course, be dependent upon the particular character and needs of the viscous product 60 to be dispensed, the expected shelf life for the viscous product 60 prior to and during consumption, the anticipated strength needs of the package and the type of sealing operations to be employed.

The Suckback Valve

The suckback valve 30 serves several functions. In a highly preferred embodiment it contributes to creating suckback at the dispensing orifice 20 in the shroud 22 as soon as the opposed squeezing forces "F" are removed from the package, it substantially controls the volume of air allowed to enter the dispensing orifice 20 during the recovery cycle of the resilient outer wall 12 to its substantially undeformed condition, and it substantially prevents the entry of air into the product contained within the flexible bag 10 over extended periods of time between dispensing cycles even if the closure 21 is not reapplied to seal the dispensing orifice 20. This not only prevents dryout of the viscous product 60 contained within the flexible bag 10, but in addition, minimizes the slumping of product from the shroud 22 into the bottom of the bag between dispensing cycles.

By permitting only a limited volume of air to be drawn into the dispensing orifice 20 at the end of each dispensing cycle and by preventing slumping of product from the shroud 22 into the bottom of the flexible bag between dispensing cycles, the succeeding dispensing cycle can normally be initiated with only a single squeeze on the resilient outer wall 12 of the package 50 without any appreciable belching due to entrained air within the viscous product being dispensed.

Figure 4:
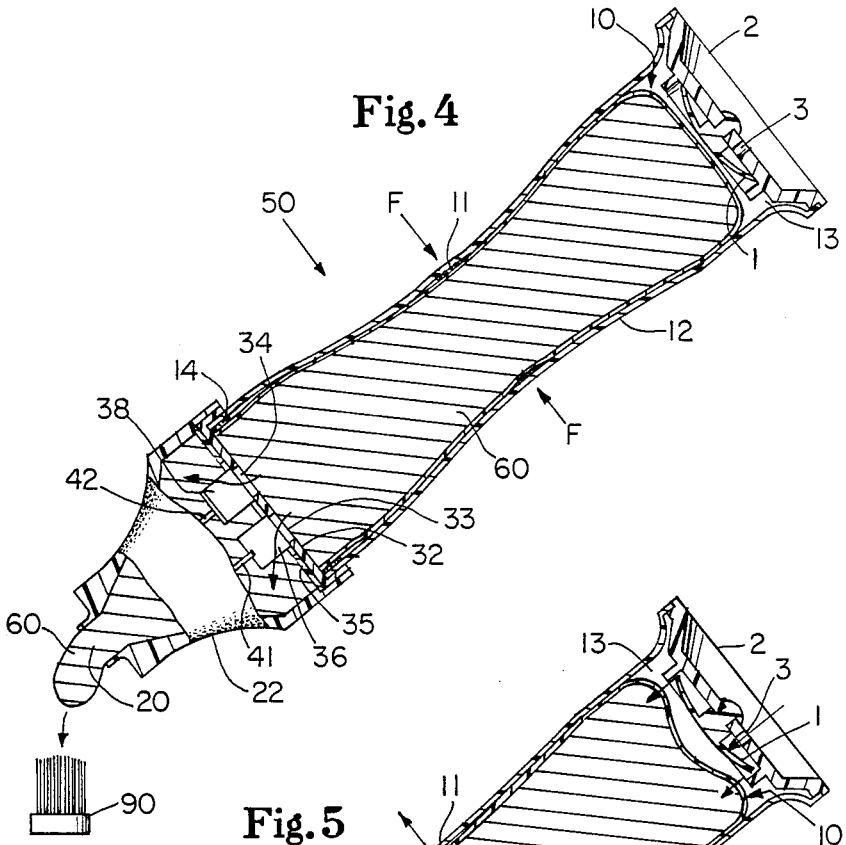
FIG. 4 is a simplified partial cross-sectional illustration of the resilient squeeze bottle dispensing package of FIGS. 1–3 shown during its initial dispensing cycle, said view being oriented in the direction of view line 4—4 of FIG. 2.
Figure 5:
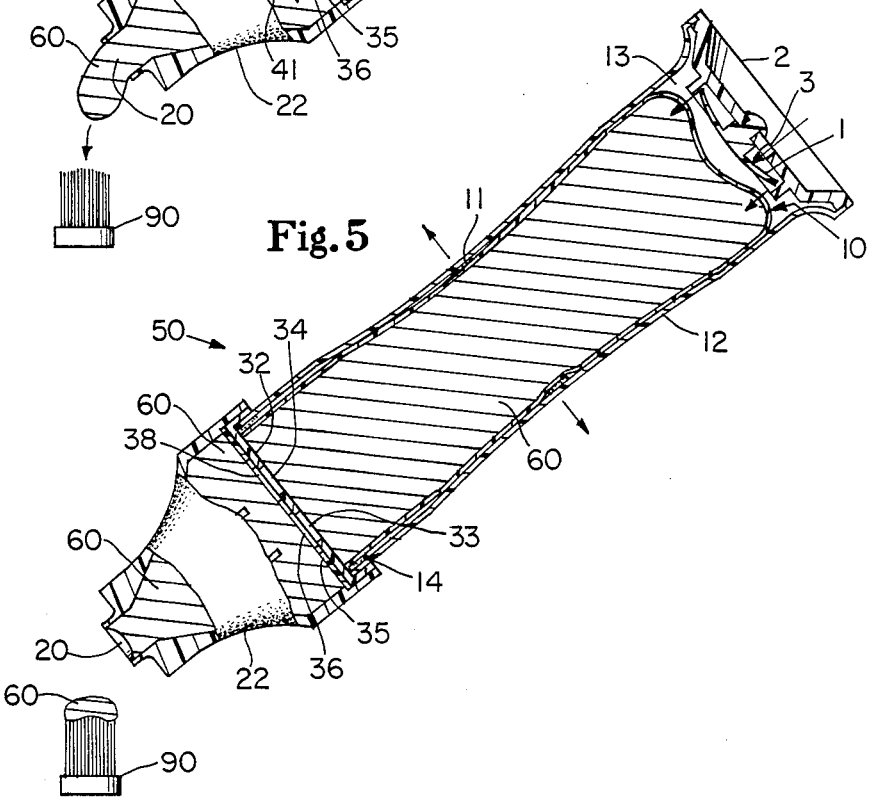
FIG. 5 is a view generally similar to that of FIG. 4, but showing the condition existing within the package when the squeezing forces have been removed from the resilient outer wall of the package.

In the illustrated embodiment, the suckback valve 30 comprises an orifice plate 32 containing orifices 33 and 34. A flex plate 35 is secured over the top of orifice plate 32. Flex plate 35 contains a pair of oppositely oriented resilient flaps 36 and 38 which, in their fully closed position, block orifices 33 and 34, respectively, in orifice plate 32. The suckback valve 30 illustrated in the accompanying Drawing Figures provides a large flow area when resilient flaps 36 and 38 are in their open position. This minimizes the pressure drop across the valve as the viscous product 60 is being dispensed. In addition, suckback valve 30 helps to transport a substantially constant volume of viscous product 60 from the shroud 22 back to flexible bag 10 each time it moves from its fully open position, as shown in FIG. 4, to its fully closed position, as shown in FIG. 5. This volume of product is essentially equivalent to the volume swept by the flexible flaps 36 and 38 as they move from their fully open to their fully closed position. This constant volume closing characteristic of preferred suckback valve 30 helps to ensure that a substantially constant volume of air is drawn back into dispensing orifice 20 at the conclusion of each dispensing cycle, regardless of how much viscous product 60 is dispensed during the cycle or how much viscous product 60 is remaining within the flexible bag 10. As mentioned earlier herein, suckback valve 30 thereby helps to provide substantially constant dispensing characteristics with a single squeeze of the resilient outer wall 12.

As will be appreciated by those skilled in the art, the exact physical configuration of the suckback valve is not critical. However, the same basic operational characteristics described in relation to the illustrated suckback valve 30 are preferably provided by whatever valve configuration is ultimately selected.

The Air Check Valve

In order to ensure that pressure is exerted on viscous product 60 contained within flexible bag 10 whenever opposed squeezing forces "F" are applied to the resilient outer wall 12 of the package 50, there needs to be some means of stopping or at least limiting the flow of air from the area 13 between the bottom of the flexible bag 10 and the interior of the package 50. While a resilient air check valve 1 has been shown in the illustrated embodiment, the use of a check valve is not absolutely essential. If desired for reasons of economy, a small diameter hole which throttles the flow of air to and from the area in question will serve substantially the same function. As the package is squeezed, the escape of air needs to be slow enough that pressure builds within flexible bag 10 and viscous product 60 is dispensed from the bag before an appreciable amount of air is lost from area 13 of the package. If desired, the hole could even be positioned so that it is blocked by the user's hand or finger during the dispensing operation.

Resilient air check valve 1 is particularly preferred, because the application of pressure in area 13 of the package will cause the uppermost portion of resilient air check valve 1 to seat tightly over the area of the base 2 containing vent hole 3, thereby substantially preventing the escape of air from the package while the opposed squeezing forces "F" are being applied. Once the opposed squeezing forces "F" are removed from resilient outer wall 12, the negative pressure created within area 13 as the resilient outer wall 12 attempts to return to its substantially undeformed condition will lift the uppermost portion of resilient air check valve 1 away from the base 2 of the package, thereby allowing air to readily enter area 13 through vent hole 3. Thus, vent hole 3 can be sized large enough to allow reasonably quick recovery of the resilient outer wall 12 upon removal of the opposed squeezing forces "F" from the package. If a small hole is utilized to restrict the flow of air in both directions in lieu of the check valve 1, return of the resilient outer wall 12 to its fully undeformed condition may be slowed, thereby requiring the user to wait for a few seconds before applying another squeezing force to dispense additional viscous material 60 from the package.

The Shroud and Dispensing Orifice

The shroud 22 is preferably secured to the uppermost end of the resilient outer wall 12 in such a manner that it retains suckback valve 30 secured in position between the uppermost end 14 of flexible bag 10 and the dispensing orifice 20 located at the uppermost tip of the shroud. The particular means employed to secure shroud 22 in position is not critical, and can comprise conventional adhesives, interlocking flanges, heat sealing or the like. As can be seen in FIGS. 2–8 the shroud 22 secures flex plate 35 immediately adjacent the uppermost surface of orifice plate 32, such that resilient flaps 36 and 38 in the flex plate will substantially block orifices 33 and 34, respectively, in the orifice plate 32 when the package is in an undistored, equilibrium condition.

In a particularly preferred embodiment, the interior surface of shroud 22 also includes a pair of stop members 41 and 42 which limit the amount of travel of resilient flaps 36 and 38 can undergo, thereby defining their fully open position. This helps to ensure that the volume of product swept by the resilient flaps when they move from their fully open to their fully closed position remains substantially constant throughout the useful life of the package 50.

A dispensing orifice 20 is provided at the uppermost tip of the shroud 22. The size and cross-sectional shape of the dispensing orifice 20 will, of course, depend upon such factors as the intended end use for the viscous material 60 to be dispensed and the surface onto which the material is to be dispensed. For a material such as dentifrice, a cylindrical dispensing orifice 20 having an inner diameter of approximately one quarter inch has been found to work well for dispensing an appropriate size ribbon of dentifrice paste onto the surface of a conventional toothbrush.

The Closure Member

In the resilient squeeze bottle dispensing package 50 illustrated in the accompanying Drawing FIGS. 1–8, a hingedly connected closure member 21 has been illustrated. The hingedly connected closure member 21 preferably includes means for establishing a airtight seal with the dispensing orifice in its closed position as well as an access lip, such as 23, to permit easy opening to initiate dispensing. While it is not a requirement that the closure member 21 be secured to the shroud 22 by means of a hinge 24, as shown in Drawing FIGS. 1–8, this form of attachment prevents loss of the closure member 21 between dispensing cycles, thereby providing greater convenience for the end user. In addition, it makes it more likely that the closure member will indeed be closed at the end of each dispensing cycle, thereby minimizing the chance of air being allowed to dry out the viscous product 60 contained within shroud 22 above the suckback valve 30.

As will be appreciated by those skilled in the art, the particular closure member selected is non-critical. Conventional screw thread closures, snap-on closures, plug-type closures or the like could be utilized with equal facility without affecting the dispensing characteristics of the present resilient squeeze bottle dispensing package. In still another embodiment of the present invention a secondary valve could be provided at the dispensing orifice to minimize the possibility of viscous product dry-out in the uppermost portions of the package between dispensing cycles. While the particular type of valve employed is non-critical, it should permit viscous product 60 to be discharged without creating significant pressure build up. In addition, it should permit air to enter the dispensing orifice 20 until the suckback valve 30 has closed. Such a valve 121 is schematically illustrated in cross-section secured across the dispensing orifice 20 of shroud 22 in the package embodiment 150 shown in FIG. 9.

The Dispensing Cycle

Figure 6:
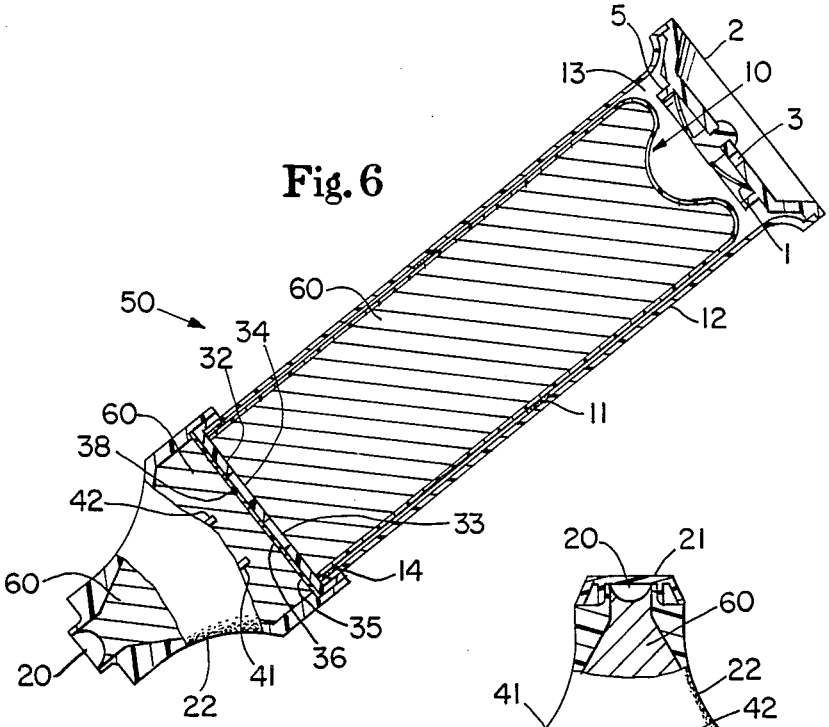
FIG. 6 is a view generally similar to that of FIGS. 4 and 5, but illustrating the condition existing within the package after the resilient outer wall of the package has fully returned to its undeformed condition.
Figure 7:
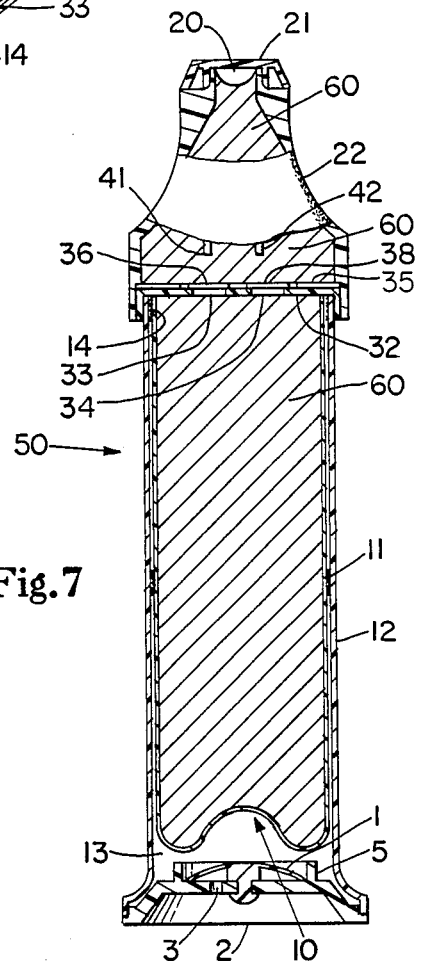
FIG. 7 is a view generally similar to those of FIGS. 4–6, but illustrating the condition existing within the resilient squeeze bottle dispensing package between dispensing cycles, i.e., the closure member has been secured across the dispensing orifice and the package has been stored on its base in an upright condition.
Figure 8:
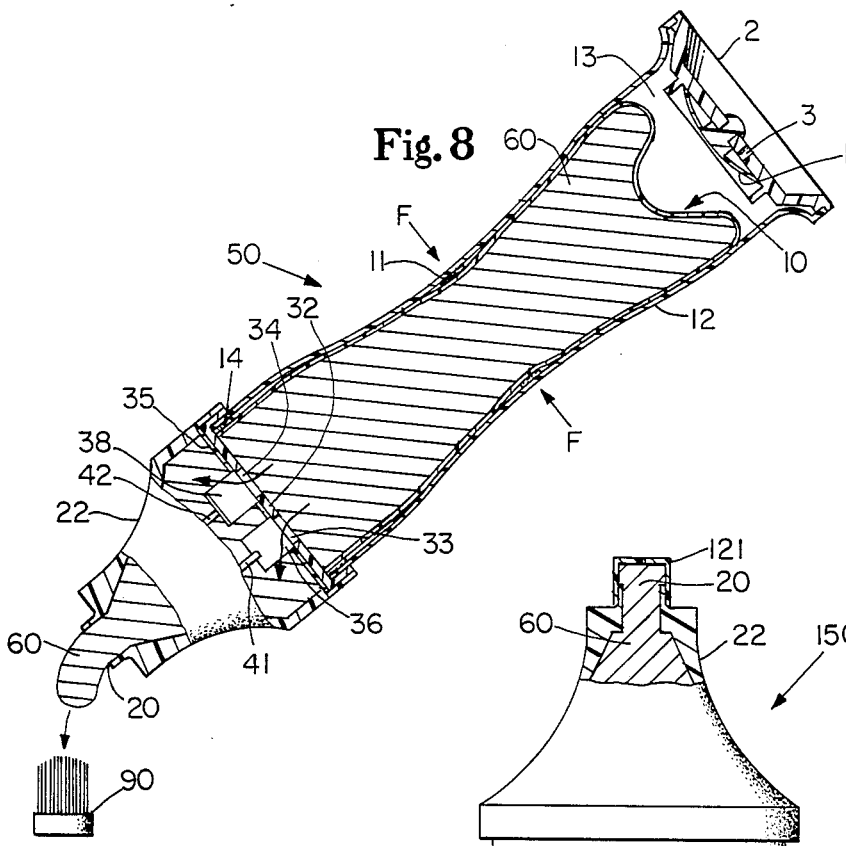
FIG. 8 is a view generally similar to those of FIGS. 4–7, but illustrating the condition existing within the package on a subsequent viscous product dispensing cycle.

FIGS. 4, 5 and 6 show an initial dispensing cycle for a resilient squeeze bottle dispensing package 50 of the present invention. FIG. 7 shows the condition which exists within the package intermediate the initial dispensing cycle shown in FIGS. 4–6 and the next dispensing cycle shown in FIG. 8.

FIG. 4 illustrates the condition existing when a resilient squeeze bottle dispensing package 50 is initially placed in service by the consumer. In particular, opposed squeezing forces "F" are applied in a direction substantially parallel to the minor axis of the resilient outer wall 12 of the package. This increases the air pressure inside the package within area 13 below the flexible bag 10, thereby causing resilient air check valve 1 to seal against the base 2. This blocks the escape of air through vent hole 3 in the base of the package. The opposed squeezing forces "F" therefore increase the pressure on viscous product 60 contained within flexible bag 10. The increased pressure of the viscous product 60 causes the resilient flaps 36 and 38 of suckback valve 30 to move from their fully closed to their fully open position, as generally shown in the cross-section of FIG. 4. Viscous product 60 flows through the orifices 33 and 34 in orifice plate 32 and enters the interior of the shroud 22. From there, the viscous material 60 passes through dispensing orifice 20 in the form of a ribbon which, in the case of a dentifrice paste, is normally deposited onto the uppermost surface of a toothbrush 90, as shown in FIG. 4.

Once the desired amount of viscous product 60 has been applied to the surface of the toothbrush 90, the opposed squeezing forces "F" are removed from the resilient outer wall 12 of the package. Because the flexible bag 10 is secured about its periphery to the innermost surface of the resilient outer wall 12 at area 11, the resilience of the outer wall 12 is effectively imparted to the flexible bag 10.

The action of the resilient outer wall 12 in attempting to return to its undeformed condition causes an immediate cessation of product discharge through the dispensing orifice 20 as well as an opening of the air check valve 1 in the base 2 of the package 50. The suckback action created within the flexible bag 10 causes a portion of the paste contained within the shroud 22 to be drawn back inside the flexible bag 10. This, in turn, causes air to be drawn into the dispensing orifice 20 as generally shown in the cross-section of FIG. 5. However, the amount of air which can be drawn back into dispensing orifice 20 is controlled by the suckback valve 30, i.e., when the resilient flaps 36 and 38 sweep from their fully open to their fully closed position, a predetermined volume of viscous product is reintroduced into the flexible bag 10. As soon as the flaps 36 and 38 block orifices 33 and 34, respectively, in orifice plate 32, there is no further tendency to draw in additional air through the dispensing orifice 20. Accordingly, only a limited and substantially constant volume of air is drawn into the dispensing orifice 20 at the conclusion of any given dispensing cycle. In addition, closure of suckback valve 30 substantially prevents slumping of the viscous product contained within shroud 22 into the bottom of the flexible bag 10. Both of these actions minimize the tendency toward belching due to entrained air on subsequent dispensing cycles. In addition, packages of the present invention permit almost immediate dispensing in response to a single subsequently applied squeezing force, since viscous product 60 substantially fills the interior of shroud 22.

As mentioned earlier herein, the resilience of outer wall 12 also causes the uppermost portion of check valve 1 to move inwardly, thereby breaking its seal against the base 2 of the package. This allows atmospheric air to enter the interior of the package in area 13 through vent hole 3, thereby causing the flexible bag 10 to move upwardly within the package, as generally shown in FIG. 6.

After the intial dispensing cycle, the hingedly connected closure member 21 is normally closed over the dispensing orifice 20, as generally shown in FIG. 7, and the package is stored in a substantially upright position on its base 2 until it is desired to dispense more viscous product 60 from the package. Because the suckback valve 30 prevents slumping of the paste contained within shroud 22 into the flexible bag 10, the void space existing at the dispensing orifice 20 does not increase appreciably intermediate dispensing cycles. This ensures that the subsequent dispensing cycle shown generally in FIG. 8 will again produce a substantially instantaneous discharge of viscous product 60 as soon as opposed squeezing forces "F" are again applied to the resilient outer wall 12 of the package.

Because of the sharp product cut-off and suckback characteristics provided at the dispensing orifice 20, resilient squeeze bottle package 50 remains substantially clean throughout successive dispensing operations from the time the package is initially placed in service until substantially all of the contents have been dispensed therefrom. By securing the flexible bag 10 to the resilient outer wall 12 substantially at the midpoint 11 of the bag, successive dispensing cycles cause the bag to gradually invert upon itself, thereby discharging substantially all of the viscous product 60 initially contained therein.

To ensure that the consumer is able to utilize substantially all of the viscous product 60 contained in the resilient squeeze bottle package 50, the interior volume of shroud 22 is normally limited to: (1) that which is required to ensure proper operation of resilient flaps 36 and 38 of suckback valve 30; and (2) that which is required to substantially prevent entry of air into the flexible bag 10 as the resilient flaps 36 and 38 are moving from their fully open to their fully closed position.

As a further aid to utilizing all of the available viscous product 60 within resilient squeeze bottle package 50, the shroud 22 can be formed of a manually deformable material which can be squeezed to empty the contents of the shroud 22 after the flexible bag 10 has been emptied.

While the present invention has been described in the context of a resilient squeeze bottle dispensing package particularly well suited for dispensing dentifrice paste, it is recognized that the present invention may be practiced to advantage in many other environments where controlled dispensing of a viscous product is desired. It is further recognized that the specific design of many of the structural elements employed may vary from one application to another. It will be obvious to those skilled in the art that various changes and modifications can be made to the present resilient squeeze bottle dispensing package without departing from the spirit and scope of the invention, and it is intended to cover in the appended claims all such modifications that are within the scope of this invention.

What is claimed is:

1. A resilient squeeze bottle package for dispensing a viscous product contained therein without any significant belching due to entrained air, said package comprising:

(a) a flexible inner bag, said bag containing said viscous product;

(b) an outer container body surrounding said flexible bag, said outer container body comprising a resilient outer wall and a closed bottom, said flexible bag being secured about its perimeter both at its uppermost end and substantially at its midpoint to the interior surface of said resilient outer wall, said outer wall of said package being sufficiently resilient that it will return the midpoint of said bag secured thereto to its substantially undeformed cross-section upon removal of opposed squeezing forces which are applied to deform said resilient outer wall of said outer container body, said return of said midpoint of said flexible bag to its substantially undeformed cross-section causing a substantially instantaneous decrease of viscous product pressure inside said flexible bag;

(c) a shroud sealingly secured to the uppermost end of said resilient outer wall, said shroud including a dispensing orifice for dispensing said viscous product from said flexible bag;

(d) a suckback valve interposed between the uppermost end of said flexible bag containing said viscous product and said dispensing orifice in said shroud, said suckback valve being capable of opening in response to an increase of viscous product pressure inside said flexible bag to permit said viscous product to pass therethrough on its way to said shroud and said dispensing orifice, said suckback valve being further capable of automatically returning to a fully closed and substantially leak resistant position in response to a sudden decrease of viscous product pressure inside said flexible bag, said suckback valve having positive stop means to prevent the flow of viscous product or air from said shroud into said flexible inner bag when said suckback valve is in its fully closed and substantially leak resistant position, whereby a substantially instantaneous decrease of viscous product pressure occurring inside said flexible bag due to removal of said opposed squeezing forces from said resilient outer wall of said outer container body will cause the flow of viscous product from said dispensing orifice to cease and air to flow back into said dispensing orifice until said suckback valve has returned to its fully closed and substantially leak resistant position; and (e) means for restricting the exit of air from inside said container body in the area beneath the lowermost end of said flexible bag when opposed squeezing forces are applied to the exterior surface of said resilient outer sidewall of said package, whereby the pressure of said viscous product contained in said flexible bag is increased in response to said opposed squeezing forces to effect dispensing of said viscous product from said dispensing orifice in said shroud so long as said opposed squeezing forces are maintained on said resilient outer wall of said package.

2. The resilient squeeze bottle dispensing package of claim 1, wherein said suckback valve comprises an orifice plate containing at least one orifice and a superposed flex plate containing at least one resilient flap pivotally connected to said flex plate, said resilient flap being bigger in size than said orifice, said valve having a fully closed position wherein said pivotally connected flap completely blocks said orifice in said orifice plate and a fully open position wherein said resilient flap is pivoted away from said orifice in said orifice plate to fully expose said orifice, said flap sweeping a substantially constant volume of said viscous product each time it pivots between said fully open and said fully closed positions of said valve, said positive stop means comprising said orifice in said orifice plate and said superposed flap which is prevented from passing through said orifice because it is bigger in size than said orifice, whereby said flap aids in the transport of a substantially constant volume of said viscous product from said shroud into said flexible bag each time said valve moves from its fully open to its fully closed position.

3. The resilient squeeze bottle dispensing package of claim 1, wherein said means for restricting the exit of air contained in the area beneath said flexible bag and the interior of said container body comprises a check valve located in the lowermost portion of said container body.

4. The resilient squeeze bottle dispensing package of claim 1, including a closure member for sealing said dispensing orifice in said shroud from the atmosphere after completion of a viscous product dispensing cycle.

5. The resilient squeeze bottle dispensing package of claim 4, wherein said closure member is hingedly connected to said shroud to prevent its becoming lost during use.

6. The resilient squeeze bottle dispensing package of claim 1, wherein said viscous product comprises a dentifrice paste and wherein said flexible bag is comprised of a barrier material capable of preventing loss of flavor, perfume and active ingredients from said dentifrice paste during extended periods of storage in said package.

7. The resilient squeeze bottle dispensing package of claim 6, wherein said barrier material comprising said bag is a laminate film including a substantially continuous layer of aluminum.

8. The resilient squeeze bottle dispensing package of claim 1, wherein said bottom of said container body comprises a base sealingly secured thereto, said base having a lowermost surface which will permit standing said package in a vertically upright position on a level surface.

9. The resilient squeeze bottle dispensing package of claim 1, wherein said resilient outer wall of said package exhibits an oval cross-sectional shape to facilitate the application of opposed squeezing forces in a direction substantially parallel to the minor axis of said oval.

10. The resilient squeeze bottle dispensing package of claim 2, wherein said suckback valve includes a pair of said orifices in said orifice plate and a pair of said resilient flaps in said superposed flex plate.

11. The resilient squeeze bottle dispensing package of claim 1, wherein said flexible bag is secured about its perimeter at its uppermost end and at its midpoint to the innermost surface of said resilient outer wall by means of an adhesive.

12. The resilient squeeze bottle dispensing package of claim 1, wherein said flexible bag is secured about its perimeter at its uppermost end and at its midpoint to the innermost surface of said resilient outer wall by means of a heat seal.

13. The resilient squeeze bottle dispensing package of claim 2, wherein said shroud is comprised of a deformable material which can be squeezed by the user to facilitate substantially complete emptying of said viscous product from said shroud after said flexible bag has been substantially emptied of said viscous product.

14. The resilient squeeze bottle dispensing package of claim 1, including a valve secured across said dispensing orifice in said shroud to prevent viscous product remaining in said shroud after a dispensing cycle from drying out.

15. A resilient squeeze bottle package for dispensing a viscous product contained therein without significant belching due to entrained air, said package comprising:

(a) a flexible inner bag, said bag containing said viscous product;

(b) an outer container body surrounding said flexible bag, said outer container body comprising a resilient outer wall and a closed bottom, said flexible bag being secured about its perimeter both at its uppermost end and substantially at its midpoint to the interior surface of said resilient outer wall, said outer wall of said package being sufficiently resilient that it will return the midpoint of said bag secured thereto to its substantially undeformed cross-section upon removal of opposed squeezing forces which are applied to deform said resilient outer wall of said outer container body, said return of said midpoint of said flexible bag to its substantially undeformed cross-section causing a substantially instantaneous decrease of viscous product pressure inside said flexible bag;

(c) a shroud sealingly secured to the uppermost end of said resilient outer wall, said shroud including a dispensing orifice for dispensing said viscous product from said flexible bag;

(d) a suckback valve interposed between the uppermost end of said flexible bag containing said viscous product and said dispensing orifice in said shroud, said suckback valve being capable of opening in response to an increase of viscous product pressure inside said flexible bag to permit said viscous product to pass therethrough on its way to said shroud and said dispensing orifice, said suckback valve being further capable of automatically returning to a fully closed and substantially leak resistant position in response to a sudden decrease of viscous product pressure inside said flexible bag, said valve also being capable of aiding in the transport of a substantially constant volume of said viscous product from said shroud into said flexible bag each time said valve moves from its fully open to its fully closed position, said suckback valve having positive stop means to prevent the flow of viscous product or air from said shroud into said flexible inner bag when said suckback valve is in its fully closed and substantially leak resistant position, whereby a substantially instantaneous decrease of viscous product pressure occurring inside said flexible bag due to removal of said opposed squeezing forces from said resilient outer wall of said outer container body will cause the flow of viscous product from said dispensing orifice to cease and air to flow back into said dispensing orifice until said suckback valve has returned to its fully closed and substantially leak resistant position; and (e) means for restricting the exit of air from inside said container body in the area beneath the lowermost end of said flexible bag when opposed squeezing forces are applied to the exterior surface of said resilient outer sidewall of said package, whereby the pressure of said viscous product contained in said flexible bag is increased in response to said opposed squeezing forces to effect dispensing of said viscous product from said dispensing orifice in said shroud so long as said opposed squeezing forces are maintained on said resilient outer wall of said package.

16. The resilient squeeze bottle dispensing package of claim 15, wherein said means for restricting the exit of air contained in the area beneath said flexible bag and the interior of said container body comprises a check valve located in the lowermost portion of said container body.

17. The resilient squeeze bottle dispensing package of claim 15, including a closure member for sealing said dispensing orifice in said shroud from the atmosphere after completion of a viscous product dispensing cycle.

18. The resilient squeeze bottle dispensing package of claim 17, wherein said closure member is hingedly connected to said shroud to prevent its becoming lost during use.

19. The resilient squeeze bottle dispensing package of claim 17, wherein said viscous product comprises a dentifrice paste and wherein said flexible bag is comprised of a barrier material capable of preventing loss of flavor, perfume and active ingredients from said dentifrice paste during extended periods of storage in said package.

20. The resilient squeeze bottle dispensing package of claim 19, wherein said barrier material comprising said bag is a laminate film including a substantially continuous layer of aluminum.

21. The resilient squeeze bottle dispensing package of claim 15, including a valve secured across said dispensing orifice in said shroud to prevent viscous product remaining in said shroud after a dispensing cycle from drying out.

22. A resilient squeeze bottle package for dispensing a viscous product contained therein without significant belching due to entrained air, said package comprising:

(a) an outer container body comprising a resilient outer wall and a closed bottom;

(b) a flexible inner bag having an overall height approximately half that of said resilient outer wall of said container body, said flexible bag being sealingly secured completely about its perimeter at its uppermost end to the interior surface of said resilient outer wall at approximately the midpoint of said resilient outer wall, said viscous product being contained within said flexible bag and the upper portion of said resilient outer wall extending above the point of securement of said bag to said wall, said outer wall of said package being sufficiently resilient that it will return the uppermost end of said bag secured thereto to its substantially undeformed cross-section upon removal of opposed squeezing forces which are applied to deform said resilient outer wall of said outer container body, said return of said uppermost end of said flexible bag to its substantially undeformed cross-section causing a substantially instantaneous decrease of viscous product pressure inside said flexible bag;

(c) a shroud sealingly secured to the uppermost end of said resilient outer wall, said shroud including a dispensing orifice for dispensing said viscous product from said flexible bag;

(d) a suckback valve interposed between the uppermost end of said resilient outer wall containing said viscous product and said dispensing orifice in said shroud, said suckback valve being capable of opening in response to an increase of viscous product pressure inside said flexible bag and said upper portion of said resilient outer wall to permit said viscous product to pass therethrough on its way to said shroud and said dispensing orifice, said suckback valve being further capable of automatically returning to a fully closed and substantially leak resistant position in response to a sudden decrease of viscous product pressure inside said flexible bag and said upper portion of said resilient outer wall, said valve also being capable of aiding in the transport of a substantially constant volume of said viscous product from said shroud into said flexible bag and said upper portion of said resilient outer wall each time said valve moves from its fully open to its fully closed position, said suckback valve having positive stop means to prevent the flow of viscous product or air from said shroud into said flexible inner bag and said upper portion of said resilient outer wall when said suckback valve is in its fully closed and substantially leak resistant position, whereby a substantially instantaneous decrease of viscous product pressure occurring inside said flexible bag and said upper portion of said resilient outer wall due to removal of said opposed squeezing forces from said resilient outer wall of said outer container body will cause the flow of viscous product from said dispensing orifice to cease and air to flow back into said dispensing orifice until said suckback valve has returned to its fully closed and substantially leak resistant position; and (e) means for restricting the exit of air from inside said container body in the area beneath the lowermost end of said flexible bag when opposed squeezing forces are applied to the exterior surface of said resilient outer wall of said package, whereby the pressure of said viscous product contained in said flexible bag and said upper portion of said resilient outer wall is increased in response to said opposed squeezing forces to effect dispensing of said viscous product from said dispensing orifice in said shroud so long as said opposed squeezing forces are maintained on said resilient outer wall of said package.

23. The resilient squeeze bottle dispensing package of claim 22, wherein said means for restricting the exit of air contained in the area beneath said flexible bag and the interior of said container body comprises a check valve located in the lowermost portion of said container body.

24. The resilient squeeze bottle dispensing package of claim 23, wherein said viscous product comprises a dentifrice paste and wherein said flexible bag and said resilient outer wall are comprised of a barrier material capable of preventing loss of flavor, perfume and active ingredients from said dentifrice paste during extended periods of storage in said package.

25. The resilient squeeze bottle dispensing package of claim 23, wherein said resilient outer wall of said package exhibits an oval cross-sectional shape to facilitate the application of opposed squeezing forces in a direction substantially parallel to the minor axis of said oval.

* * * * *

UNITED STATES PATENT AND TRADEMARK OFFICE

CERTIFICATE OF CORRECTION

PATENT NO. : 4,842,165

DATED : June 27, 1989

INVENTOR(S) : Robert H. Van Coney

It is certified that error appears in the above-identified patent and that said Letters Patent is hereby corrected as shown below:

Title page:

In the ABSTRACT, line 10, "ae" should read -- are --.

Page 2 of the References Cited Section, Column 2, line 5, "Eyezich" should read -- Evezich --.

Column 4, line 35, "recesed" should read -- recessed --.

Column 4, line 40, "dispening" should read -- dispensing --.

Column 8, line 39, "a" should read -- an --.

Signed and Sealed this

Twenty-sixth Day of June, 1990

*Attest:*

HARRY F. MANBECK, JR.

*Attesting Officer*

*Commissioner of Patents and Trademarks*